US006744014B1

(12) United States Patent
Tanamachi et al.

(10) Patent No.: US 6,744,014 B1
(45) Date of Patent: Jun. 1, 2004

(54) APPARATUS FOR CONTROLLING TEMPERATURE OF MOVEABLE ELECTRICALLY HEATED OBJECTS/DRUMS

(75) Inventors: Steven W. Tanamachi, Lauderdale, MN (US); John A. Harrington, Maplewood, MN (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/352,640

(22) Filed: Jan. 28, 2003

(51) Int. Cl.[7] ..... H05B 1/02; G08C 23/04; G03G 15/20

(52) U.S. Cl. ..... 219/216; 219/471; 399/69; 374/154

(58) Field of Search ..... 219/216, 469, 219/471; 399/69, 330, 331, 334; 374/153, 154

(56) References Cited

U.S. PATENT DOCUMENTS 3,619,612 A * 11/1971 Belke et al. ..... 374/154
4,248,095 A * 2/1981 Akatsu et al. ..... 374/154
4,518,962 A * 5/1985 Imose et al. ..... 374/154
4,560,860 A * 12/1985 Fauser ..... 219/470
5,383,371 A * 1/1995 Laitinen ..... 73/862.55
5,580,478 A 12/1996 Tanamachi et al.

FOREIGN PATENT DOCUMENTS

JP 2003256973 A * 9/2003

* cited by examiner

*Primary Examiner*—Joseph Pelham
(74) *Attorney, Agent, or Firm*—William F. Noval

(57) ABSTRACT

A temperature controlled apparatus comprising: an object having a surface and being rotatable about an axis; an electrical heater assembly thermally coupled to the surface of the object; a temperature sensor assembly mounted on the object for sensing the temperature of the object surface and for producing temperature signals representative of the sensed temperatures; a microprocessor non-rotatably mounted with respect to the rotatable object; an optical communication link for transmitting the temperature signal to the microprocessor; and a temperature control assembly, non-rotatably mounted with respect to the rotatable object for controlling the flow of electrical power to the heater in response to control signals from the microprocessor as a function of the transmitted temperature signals.

8 Claims, 5 Drawing Sheets

APPARATUS FOR CONTROLLING TEMPERATURE OF MOVEABLE ELECTRICALLY HEATED OBJECTS/DRUMS

FIELD OF THE INVENTION

This invention relates in general to apparatus for controlling temperature and, more particularly, to apparatus for controlling the temperature of moveable, electrically heated objects and, preferably, rotatable, electrically heated drums.

BACKGROUND OF THE INVENTION

Photothermography is an established imaging technology. In photothermography, a photosensitive media is exposed to radiation to create a latent image which can be thermally processed to develop the latent image. Devices and methods for implementing this thermal development process are generally known and include contacting the imaged photosensitive media with a heated platen, drum or belt, blowing heated air onto the media, immersing the media in a heated inert liquid and exposing the media to radiant energy of a wavelength to which the media is not photosensitive, e.g., infrared. Of these conventional techniques, the use of heated drums is particularly common.

A common photosensitive media usable in these imaging processes is known as a photothermographic media, such as film and paper. One photothermographic media has a binder, silver halide, organic salt of silver (or other reducible, light-insensitive silver source), and a reducing agent for the silver ion. In the trade, these photothermographic media are known as dry silver media, including dry silver film.

In order to precisely heat exposed photothermographic media, including film and paper, it has been found to be desirable to use electrically heated drums. In apparatus employing this technique, a cylindrical drum is heated to a temperature near the desired development temperature of the photothermographic media. The photothermographic media is held in close proximity to the heated drum as the drum is rotated about its longitudinal axis. When the temperature of the surface of the heated drum is known, the portion of the circumference around which the photothermographic media is held in close proximity is known and the rate of rotation of the drum is known, the development time and temperature of the photothermographic media can be determined. Generally, these parameters are optimized for the particular photothermographic media utilized and, possibly, for the application in which the photothermographic media is employed.

In order to achieve a high quality-image in the photothermographic media, very precise development parameters must be maintained. Generally, the circumference of the drum over which the photothermographic media travels will not vary significantly. Also, the rate of rotation of the drum, or the transport rate of the photothermographic media through the thermal processor, can be rather precisely maintained. However, it is generally more difficult to control and maintain the temperature of the surface of the drum.

In addition, other factors also contribute to inaccurate processing. The closeness of the proximity which the photothermographic media is held to the drum partially determines the temperature at which the emulsion in the photothermographic media is heated. Further, the presence of foreign particles between the drum and the photothermographic media can interrupt the flow of heat from the drum to the photothermographic media which can affect image quality.

Because many factors affect image quality, one of which is the temperature at which the photothermographic media is developed, the preciseness at which the surface temperature of the drum can be maintained is important to thermal processing of photothermographic media.

The temperature of the drum depends upon many factors. These include the rate at which heat is delivered to the drum, the thermal conductivity and the thermal mass of the drum, the thermal mass of the photothermographic media, the rate, i.e., the number of sheets (if sheet photothermographic media is used) of photothermographic media being processed, the ambient temperature, whether thermal processing is just beginning or whether the thermal processing is in the middle of a long run.

In addition, heated drums are used extensively in various other material processing applications. Examples include calendaring, laminating, coating and drying.

Typically, heat is delivered to such drums through the use of electrical resistance heating elements. Since the heated drum is rotating during thermal processing and since it is a desirable to deliver electrical power to the electrical resistance heating elements during rotation of the drum, is desirable to be able to deliver electrical power from a stationary power source, e.g., the standard AC line, to the moving, rotating drum. Electrical power may be delivered to the drum through the use of slip rings coupled to the drum.

In addition, to precisely control the temperature of the electrically heated drum there should be a means to sense the temperature of the drum and a means to control the electrical power applied to the electrical resistance heaters in response to the signal from the temperature sensor.

While temperature control techniques and apparatus are common, the use of such techniques and apparatus on movable objects or rotating drums is make more difficult by movement of the object of the rotation of the drum.

One solution has been to locate all temperature sensing and control techniques on the movable object or rotating drum. In the case of a rotating drum, analog temperature control techniques have been used by incorporating a circuit board containing the analog circuitry on or near the rotating drum allowing the circuit board to rotate along with the drum. While this technique minimizes the difficulty of communicating temperature sensing information and control information between the drum and the analog circuitry, it makes it more difficult to interface to the analog control circuitry or to change or adjust the temperature or control algorithm.

A similar technique, employed by Systek, Minneapolis, Minn. utilizes rotating temperature control circuitry and additionally provides a technique for the communication of sensed temperature information from the rotating drum/control circuitry and the communication of adjustment parameters from the user of the thermal processor utilizing the drum to the rotating drum/control circuitry. A ring of a plurality of light emitting diodes are arranged in a generally circular pattern on one end of the drum/control circuitry. A single light emitting diode is positioned on a stationary board near to that one end of the rotating drum/control circuitry. A light sensor is located on the rotating drum/control circuitry on the one end of the axis or rotation. Similarly, a second light sensor is located on the stationary board. Each light sensor is adapted to sense the duty cycle modulated pulse train of the corresponding light emitting diode(s) on the opposite member. Interference in light transmission is minimized by having each pair of light emitting diodes and sensors act at a different frequency. For example, one pair could operate in the visible spectrum and the other pair could operate in the infrared spectrum.

However, the Systek system is limited to the reading of rather coarse temperature sensing information. Further, all of the temperature control loop circuitry is entirely located on the rotating drum/control circuitry board. Thus, any intelligence built into the temperature control loop must be able to be contained on the rotating drum/control circuitry board, limiting the power and options available.

Another solution is described in U.S. Pat. No. 5,580,478, issued Dec. 3, 1996, inventors Tanamachi et al. This U.S. Patent discloses a method of synchronously transmitting frequency modulated signals corresponding to each heating zone's temperature via a bi-directional infrared optical link from the movable heated object to a stationary microprocessor system. The microprocessor then transferred heater control information back across the bi-directional optical link to the movable heated object. These signals controlled the application of power to the appropriate heater via solid state relays mounted on the movable object.

There is thus a need for a less complex temperature control system for a rotatable heated drum.

SUMMARY OF THE INVENTION

According to the present invention, there is provided a solution to the problems discussed above.

According to a feature of the present invention, there is provided a temperature controlled apparatus comprising:

- an object having a surface and being rotatable about an axis;
- an electrical heater assembly thermally coupled to said surface of said object;
- a temperature sensor assembly mounted on said object for sensing the temperature of said object surface and for producing temperature signals representative of the sensed temperatures;
- a microprocessor non-rotatably mounted with respect to said rotatable object;
- an optical communication link for transmitting said temperature signal to said microprocessor; and
- a temperature control assembly, non-rotatably mounted with respect to said rotatable object for controlling the flow of electrical power to said heater in response to control signals from said microprocessor as a function of said transmitted temperature signals.

ADVANTAGEOUS EFFECT OF THE INVENTION

The invention has the following advantages.

1. The surface of a temperature controlled heated movable object and rotatable heated drum is maintained at a very accurate temperature by accurately communicating precisely sensed temperature information from the moving object/drum and by sending precisely timed power to the heaters in the moving object/drum.

2. Higher processing power and more sophisticated temperature control techniques are achieved.

DETAILED DESCRIPTION OF THE INVENTION

In general, the present invention provides a temperature controlled heated movable object/rotatable heated drum and an apparatus for controlling the temperature of a rotatable heated movable object/heated drum. Very accurate temperature at the surface of the object/drum can be maintained due, in part, to the ability to accurately communicate precisely sensed temperature information from the movable/rotatable object/drum and to send precisely timed power to the heaters in the movable/rotatable object/drum. This allows a portion of the temperature control loop circuitry to be located on a stationary object which, in turn, allows the use of higher processing power and more sophisticated temperature control techniques.

More particularly, the present invention provides a temperature controlled, electrically heated drum. A cylindrical drum has a surface and is rotatable on an axis. An electrical heater is thermally coupled to the surface of the cylindrical drum. A temperature control mechanism, non-rotatably mounted in conjunction with the cylindrical drum and electrically coupled to the electrical heaters through slip rings, controls the temperature by controlling the flow of electricity to the electrical heaters in response to control signals from the non-rotatably mounted microprocessor. A temperature sensor mechanism, rotatably mounted in conjunction with the cylindrical drum and electrically coupled to the temperature sensor, senses the temperature of the surface of the cylindrical drum and produces temperature signals indicative thereof. A microprocessor, non-rotatably mounted with respect to the cylindrical drum, controls the temperature of the electrically heated drum by generating the control signals in response to the temperature signals. An optical mechanism, coupled to the temperature control means, the temperature sensor means and rotating microprocessor means, optically couples the temperature signals from the rotating temperature sensor means to the non-rotating microprocessor means.

Figure 1:
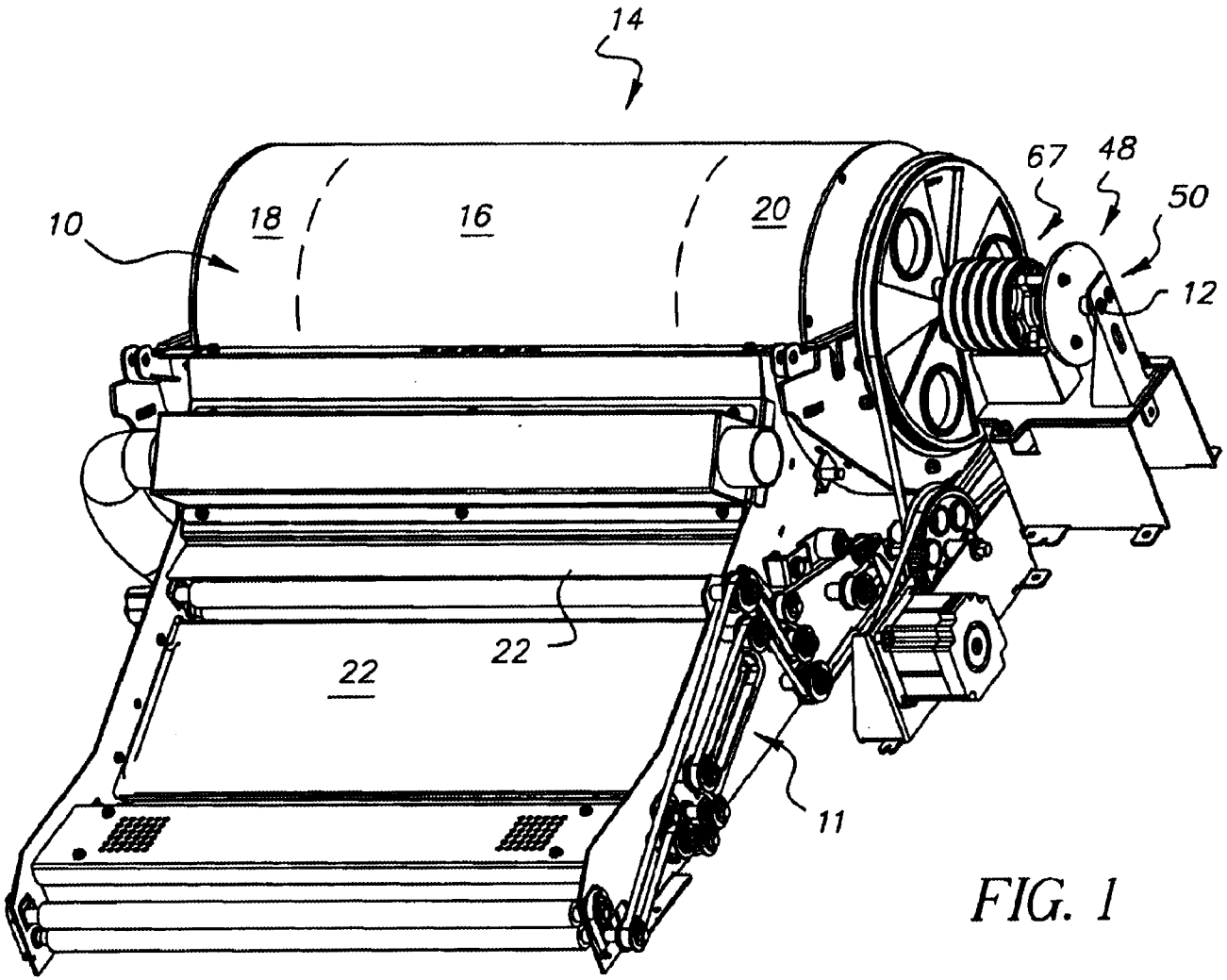
FIG. 1 is an isometric view of a portion of a thermal processor utilizing a rotatable, electrically heated drum.
Figure 2:
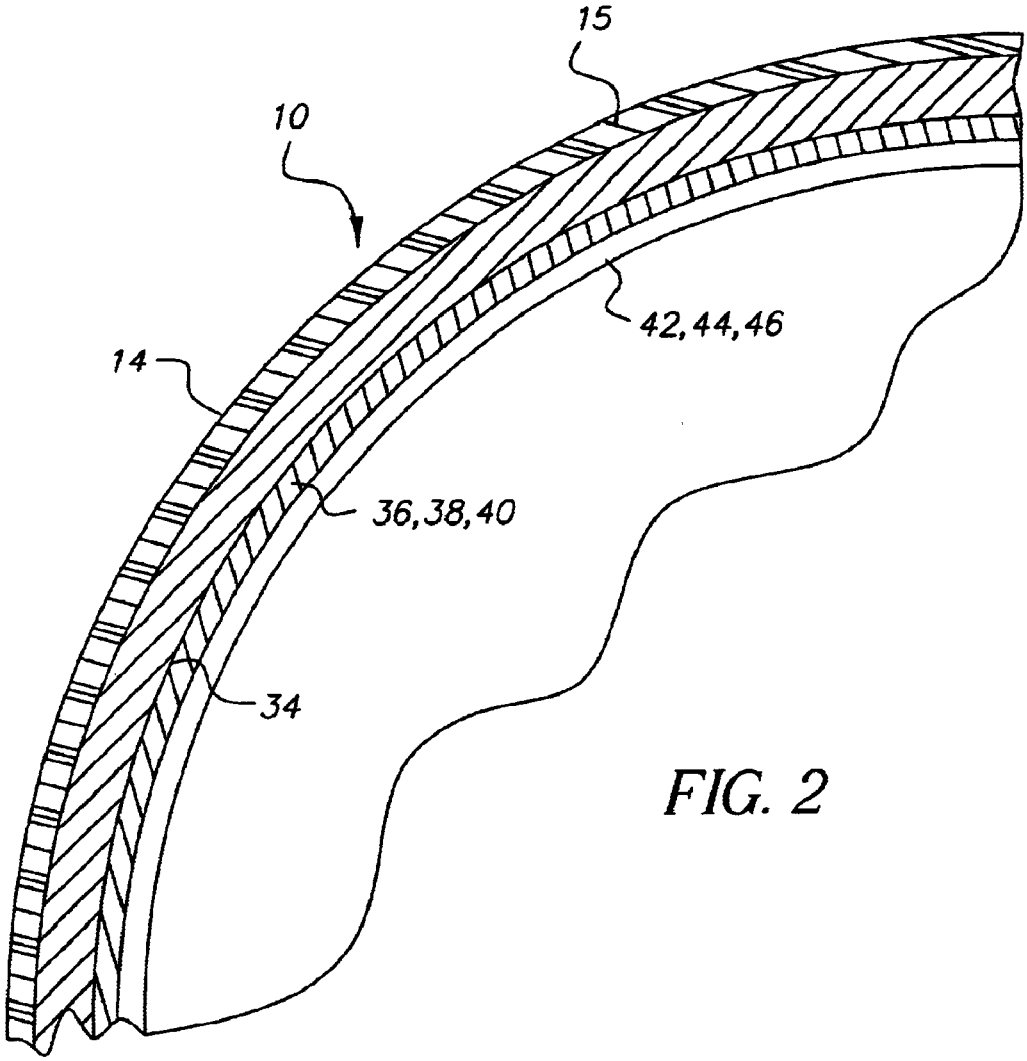
FIG. 2 is a cross-sectional view of the drum shown in FIG. 1.

A portion of a thermal processor utilizing a rotatable electrically heated drum 10 is illustrated in FIGS. 1 and 2. Such a thermal processor may be used to process medical diagnostic quality dry silver film. Cylindrical drum 10, mounted on frame 11, is rotatable around axis 12. Optionally, exterior surface 14 of drum 10 may be coated with silicone layer 15. Also, optionally, exterior surface 14 of drum 10 is divided into separately controlled heating zones 16, 18, 20. Since the edges of surface 14 of drum 10 may cool more than the central portion of surface 14, a central zone 16 is controlled independently of edge zones 18 and 20. Photothermographic media (not shown) is held in close proximity of exterior surface 14 and drum 10 over a portion of the circumference of drum 10 by means of holding down rollers (not shown). With a known temperature of exterior surface 14 of drum 10, typically 252 degrees Fahrenheit, a known rotational rate, and a known portion of circumference of surface 14 over which the photothermographic media passes, a known development temperature and dwell time can be achieved. After heated development, a cooling system 22 cools the photothermographic media to a temperature below development temperature. The cooled media is then transported to an output tray.

As shown in FIG. 2, cylindrical drum 10 is constructed from aluminum having a diameter, for example, of 8 inches (20.32 centimeters) and with a hollow interior and shell thickness for example, of 0.25 inches (0.635 centimeters). Mounted on the interior surface 34 of drum 10 are electrical resistance heaters 36, 38 and 40 adapted to heat zones 16, 18, 20, respectively. Exterior surface 14 of drum 10 may have a very delicate silicone coating 15, so temperature measurement of the drum is done internally in order not to damage the surface coatings. Mounted on the interior surface 34 of drum 10 are temperature sensors 42, 44 and 46 adapted to sense the temperature of zones 16, 18 and 20, respectively.

The temperature of exterior surface 14 is maintained across drum 10 and from sheet to sheet of photothermographic media to within .+−0.0.5 degrees Fahrenheit in order to produce diagnostic quality images.

Figure 3:
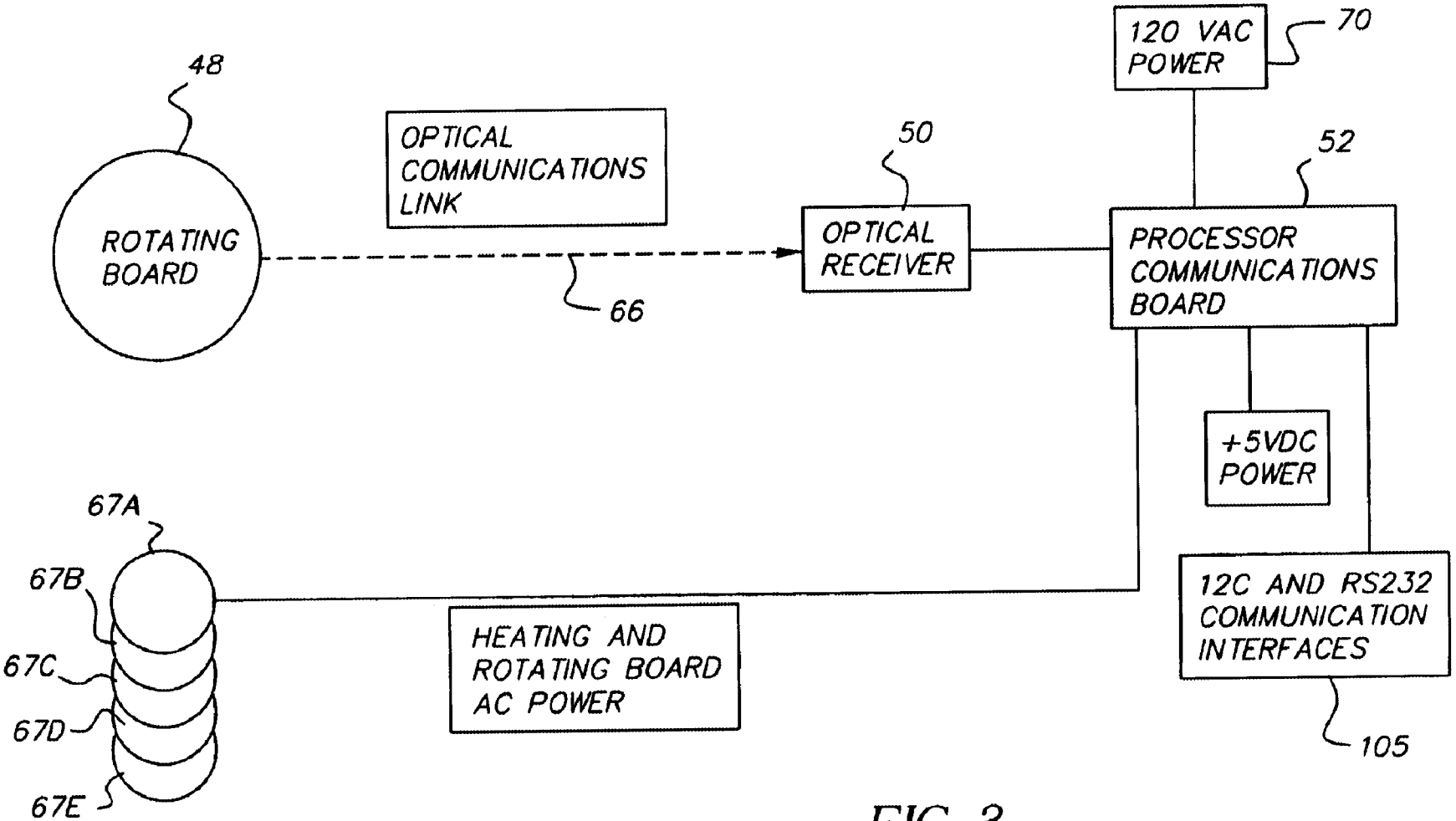
FIG. 3 is a high level block diagram of an electronic temperature control apparatus constructed in accordance with the present invention.

A high level block diagram of the major components of the temperature control circuitry is illustrated in FIG. 3. Since drum 10 is rotating, communication to electrical resistance heaters 36, 38 and 40 is done by way of slip ring assembly 67 which is mounted on one end of cylindrical drum 10 and which rotates at the same rate as drum 10. As shown in FIG. 3, circuit board 48 is optically coupled by stationary mounted optical receiver 50 positioned to optically cooperate with rotating circuit board 48. One way communication occurs over optical communications link 66 from the rotating board to the non-rotating processor communication board 52 through optical receiver 50. Rotating circuit board 48 rotates with drum 10 to communicate temperature information from the three drum heated zones 16, 18, 20 to software located on processor communications board 52 via link 66 to optical receiver 50. Processor communications board 52 contains a microprocessor whose software interprets the coded temperature information from the three heater zones 16, 18, 20 and converts it to actual zone temperatures. The software then closes the control loop by calculating via a heater control algorithm whether the heater corresponding to the sensed temperature in a particular zone should be turned on or off. The microprocessor then turns on a solid state relay to apply power to the appropriate heater through slip ring assembly 67 A–E.

Figure 4:
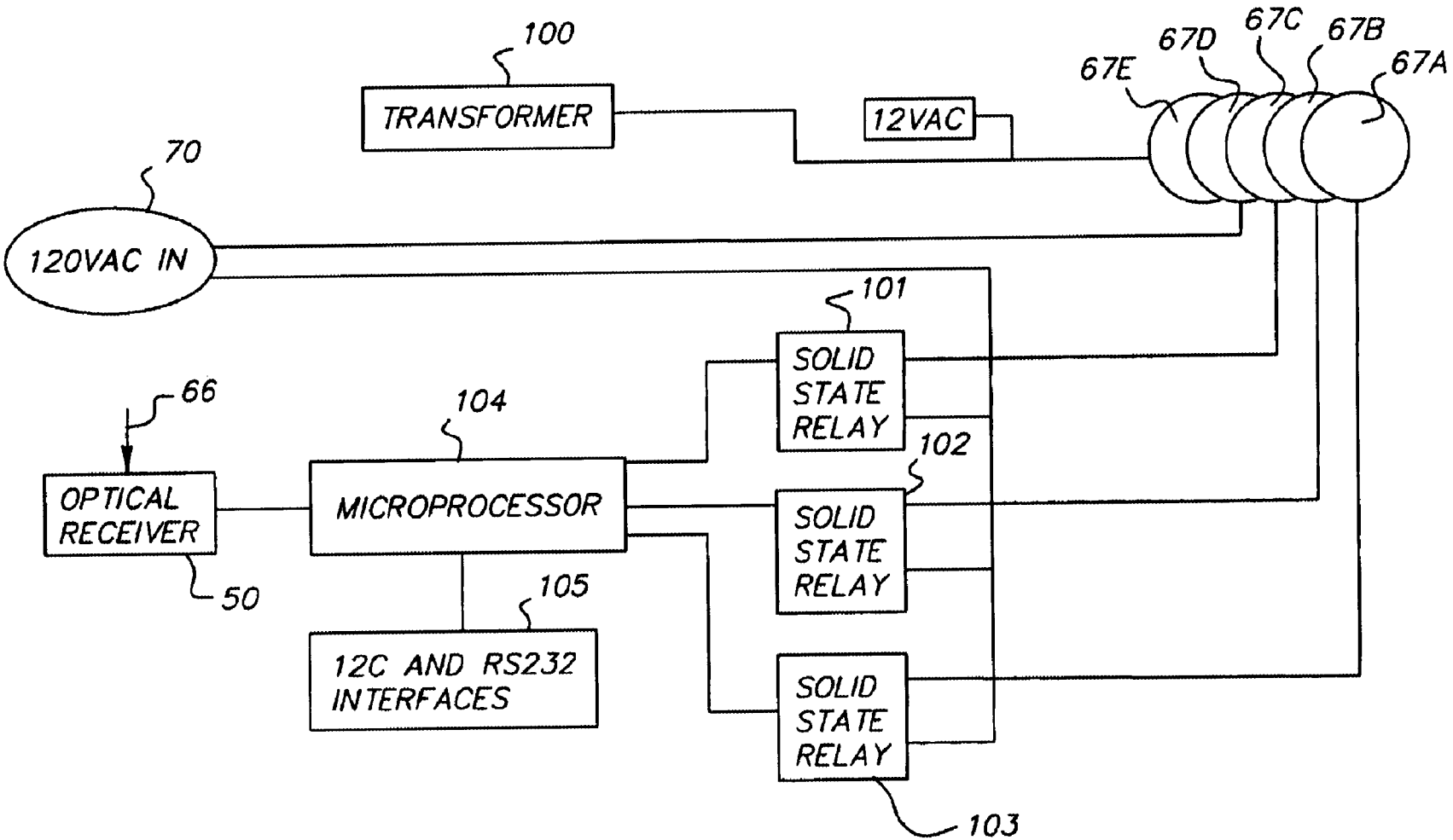
FIG. 4 is a block diagram of a processor communication board utilized in the temperature control apparatus of FIG. 3.

More detail of the function of the processor communication board 52 is shown in FIG. 4. 120Vac from source 70 of the imager in which drum 14 is mounted is brought in to the board 52 to power the processor heaters and supply 12Vac to power the rotating board. The 12Vac is supplied via step down transformer 100. There are three solid state relays 101, 102 and 103 which control power to each of the three drum heaters 36, 38 and 40 under control of microprocessor 104. Coded 12 bit digital temperature data is supplied to the microprocessor 104 from each of the three temperature sensors 42, 44, 46 via optical link 66 and optical receiver 50. Communication to the rest of the imager is through the 12C interface 105. New software can also be downloaded via the communications system. Interface 105 also includes an RS232 communications port for service of the processor control system.

Figure 5:
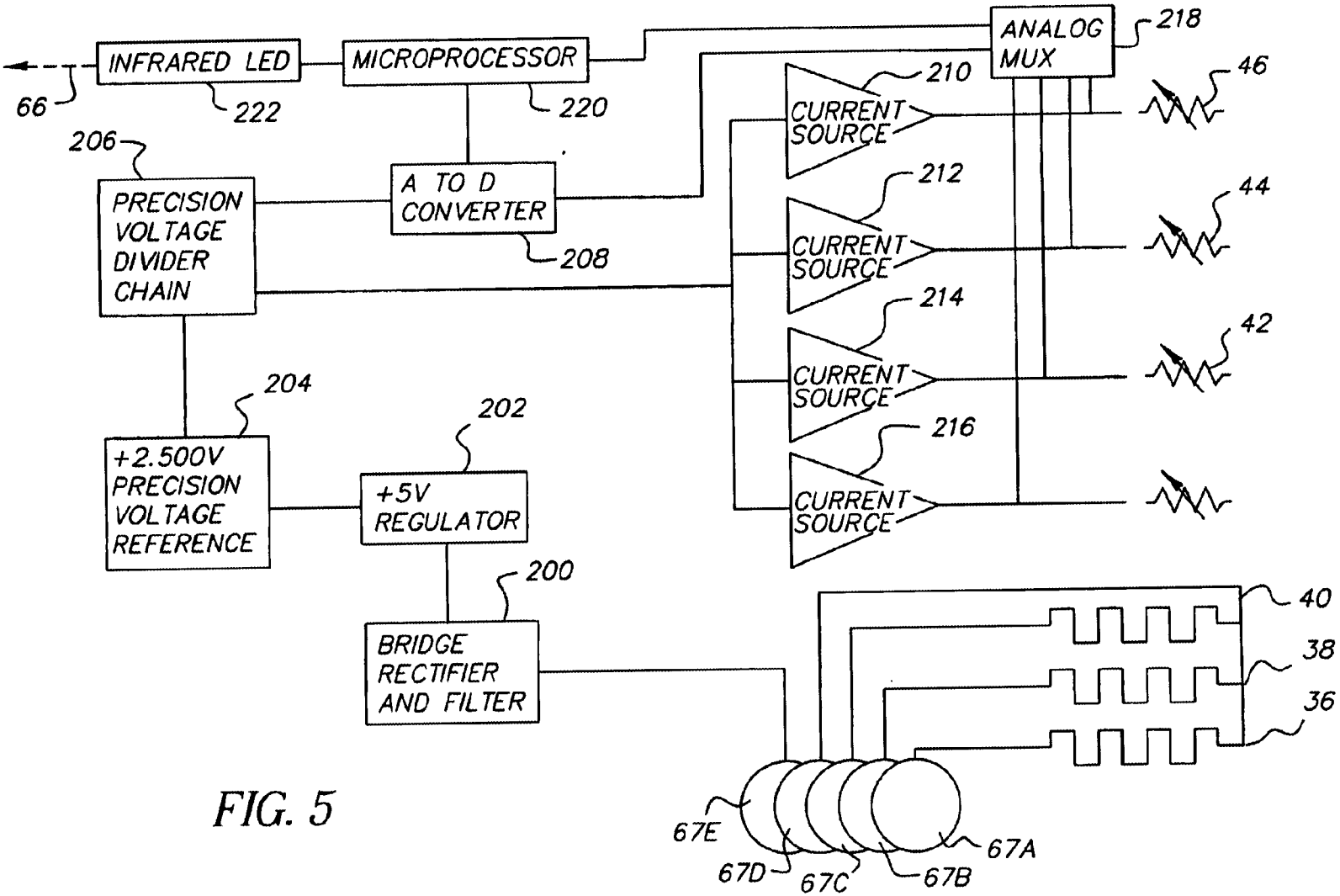
FIG. 5 is a block diagram of a rotating board utilized in the temperature control apparatus of FIG. 3.

Referring now to FIG. 5, there is shown in greater detail the electrical components disposed on the rotating drum 10. Slip rings 67 A–D supply controlled 120Vac power to resistance heaters 36, 38 and 40. 12Vac power is also supplied via slip ring 67E to bridge rectifier and filter 200 to produce a dc voltage supplied to +5V regulator 202. +2.5V precision voltage reference 204 and precision voltage divider chain 206 provide d. c. voltages to Analog to Digital Converter 208 and current sources 210–216. Current sources 210, 212 and 214 are respectively coupled to temperature sensors 46, 44, 42. The temperature signals from sensors 42, 44, 46 are applied to analog mux 218 which is controlled by rotating microprocessor 220. Mux 218 supplies the temperature signals serially to A to D converter 208 which converts them to digital signals which are communicated over optical communications link 66 by microprocessor 220 and infrared LED 222.

While the preferred embodiment has been described in relation to a thermal processor having a rotatable heated drum, the temperature control apparatus has usefulness in other application involving heated movable objects requiring precise temperature control.

Thus, it can be seen that there has been shown and described a novel apparatus for controlling the temperature of and a movable, electrically heated object. It is to be recognized and understood, however, that various changes, modifications and substitutions in the form and the details of the present invention may be made by those skilled in the art without departing from the scope of the invention as defined by the following claims.

The invention has been described in detail with particular reference to certain preferred embodiments thereof, but it will be understood that variations and modifications can be effected within the spirit and scope of the invention.

PARTS LIST

| | |
|---|---|
| 10 | drum |
| 11 | frame |
| 12 | axis |
| 14 | exterior surface |
| 15 | silicone coating |
| 16, 18, 20 | controlled heating zones |
| 22 | cooling system |
| 34 | interior surface |
| 36, 38, 40 | electrical resistance heaters |
| 42, 44, 46 | temperature sensors |
| 48 | rotating circuit board |
| 50 | optical receiver sensor |
| 52 | processor communication board |
| 66 | link |
| 67 | slip ring assembly |
| 70 | 120 Vac power |
| 100 | transformer |
| 101 | solid state relay |
| 102 | solid state relay |
| 103 | solid state relay |
| 104 | microprocessor |
| 105 | 12C and RS232 communication interfaces |
| 200 | bridge rectifier and filter |
| 204 | precision voltage reference |
| 206 | precision voltage divider chain |
| 208 | A to D converter |
| 210 | current source |
| 212 | current source |
| 214 | current source |
| 216 | current source |
| 220 | microprocessor |
| 222 | infrared LED |

What is claimed is:

1. A temperature controlled apparatus comprising:

an object having a surface and being rotatable about an axis;

an electrical heater assembly thermally coupled to said surface of said object;

a temperature sensor assembly mounted on said object for sensing the temperature of said object surface and for producing temperature signals representative of the sensed temperatures;

a microprocessor non-rotatably mounted with respect to said rotatable object;

an optical communication link for transmitting said temperature signal to said microprocessor; and a temperature control assembly, non-rotatably mounted with respect to said rotatable object for controlling the flow of electrical power to said heater in response to control signals from said microprocessor as a function of said transmitted temperature signals.

2. The apparatus of claim 1 including a source of AC power for supplying electrical power to said temperature control assembly.

3. The apparatus of claim 1 wherein said object is a rotatably mounted drum having an outer surface divided into a plurality of zones arranged longitudinally along said axis;

wherein said electrical heater assembly includes a plurality of electrical heaters, one for each of said plurality of zones;

wherein said temperature sensor assembly includes a plurality of temperature sensors, one for each of said plurality of zones, for producing temperature signals representative of sensed temperatures of said zones; and wherein said temperature control assembly controls the flow of electrical power to each of said heaters as a function of said transmitted temperature signals.

4. The apparatus of claim 3 including slip ring assemblies coupled to said rotatable drum for transmitting electrical power controlled by said temperature control assembly to said plurality of heaters.

5. A temperature controlled electrically heated drum apparatus comprising:

a drum rotatable about an axis;

an electrical heater assembly for heating said drum;

a temperature sensor assembly mounted on said drum for producing one or more temperature signals in response to sensed drum temperature;

a microprocessor, non-rotatably mounted with respect to said rotatable drum;

an optical communication link for transmitting said temperature signals; and a temperature control assembly, non-rotatably mounted with respect to said rotatably mounted with respect to said rotatable drum for controlling the flow of electrical power to said heater in response to control signals from said microprocessor as a function of said transmitted temperature signals.

6. The apparatus of claim 5 wherein said drum is divided into a plurality of zones arranged longitudinally along said axis;

wherein said electrical heater assembly includes a plurality of electrical heaters, one for each of said plurality of zones;

wherein said temperature sensor assembly includes a plurality of temperature sensors, one for each of said plurality of zones for producing temperature signals representative of sensed temperatures of said zones; and wherein said temperature control assembly controls the flow of electrical power to each of said heaters as a function of said transmitted temperature signals.

7. The apparatus of claim 6 including a slip ring assembly coupled to said rotatable drum;

said assembly including a slip ring for each of said plurality of heaters for transmitting power to each said heater.

8. The apparatus of claim 6 wherein said temperature control assembly includes a selectively controlled solid state relay for each of said plurality of heaters.

* * * * *